US007530119B1

(12) United States Patent
Jackson-Miller et al.

(10) Patent No.: US 7,530,119 B1
(45) Date of Patent: May 12, 2009

(54) REVERSIBLE NECKTIE

(76) Inventors: Carolyn Jackson-Miller, 14917 Richmond Ave., Houston, TX (US) 77082; Ernest Jackson, Jr., 9235 Worthinglake Ave., Baton Rouge, LA (US) 70810

( * ) Notice: Subject to any disclaimer, the term of this patent is extended or adjusted under 35 U.S.C. 154(b) by 145 days.

(21) Appl. No.: 11/518,006

(22) Filed: Sep. 7, 2006

(51) Int. Cl.
*A41D 25/00* (2006.01)

(52) U.S. Cl. ..... 2/144

(58) Field of Classification Search ..... 2/144–151, 2/152.1, 153–157; 24/49.1, 54, 65, 66.1
See application file for complete search history.

(56) References Cited

U.S. PATENT DOCUMENTS

| | | | | |
|---|---|---|---|---|
| 704,569 | A | | 7/1902 | Oppenheimer |
| 1,945,206 | A | | 1/1934 | Stephens |
| 2,825,904 | A | | 3/1958 | Klaus |
| 2,834,967 | A | | 5/1958 | Taksa |
| 3,264,654 | A | | 8/1966 | Woronowicz |
| 3,744,057 | A | | 7/1973 | Luceri |
| 3,953,894 | A | | 5/1976 | Aron |
| 3,959,825 | A | | 6/1976 | Hughes |
| 4,173,792 | A | * | 11/1979 | Intengan ..... 2/144 |
| 5,084,916 | A | | 2/1992 | Austin |
| D341,929 | S | | 12/1993 | Gaffney |
| 5,575,007 | A | | 11/1996 | Gaffney |
| 6,205,587 | B1 | | 3/2001 | Shiffler |
| 6,687,914 | B2 | | 2/2004 | Conyers |
| 2004/0187187 | A1 | | 9/2004 | Morrison-Gale |

* cited by examiner

*Primary Examiner*—Tejash Patel
(74) *Attorney, Agent, or Firm*—Roy, Kiesel, et al

(57) ABSTRACT

A new and improved reversible necktie is disclosed. The reversible necktie maintains the conventional appearance of traditional neckties, yet its versatile design allows it to be worn by either gender. The necktie comprises two display sides and an integrated reversing mechanism that enables a user to reverse the tie to selectively expose either side. The necktie further comprises an integrated securing mechanism to allow the user to adjustably secure the reversible necktie to the user's shirt at the desired location. The necktie further comprises an interfacing structure that provides for a durable construction, while not making the tie bulky or overweight.

4 Claims, 4 Drawing Sheets

Fig 1
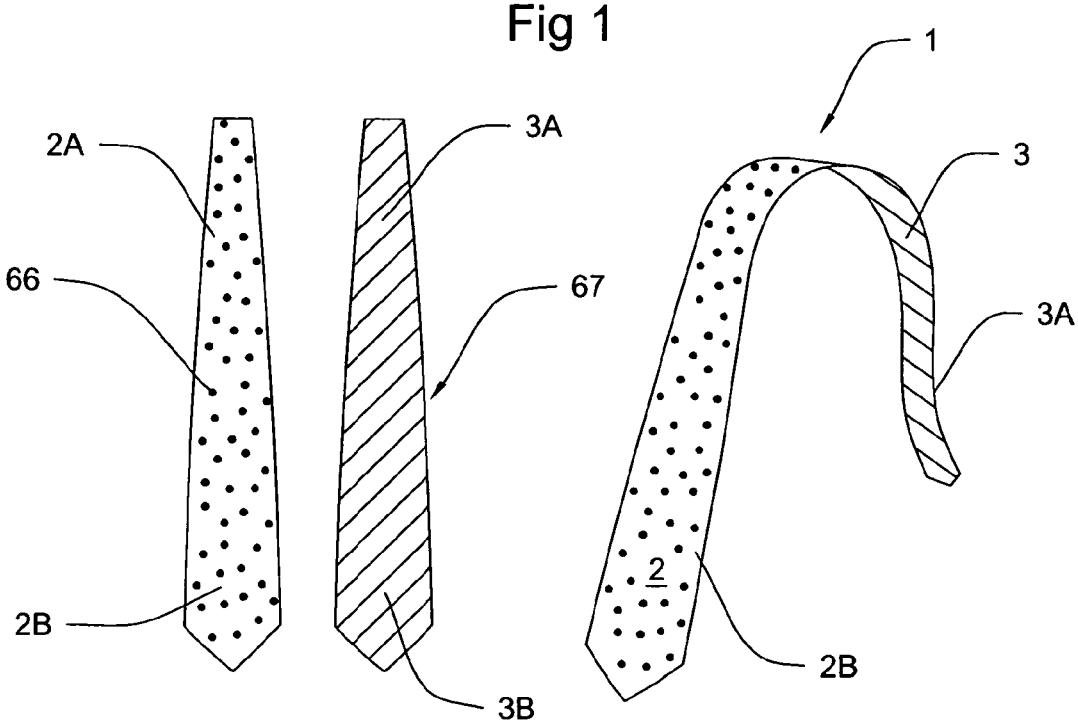
Fig 2
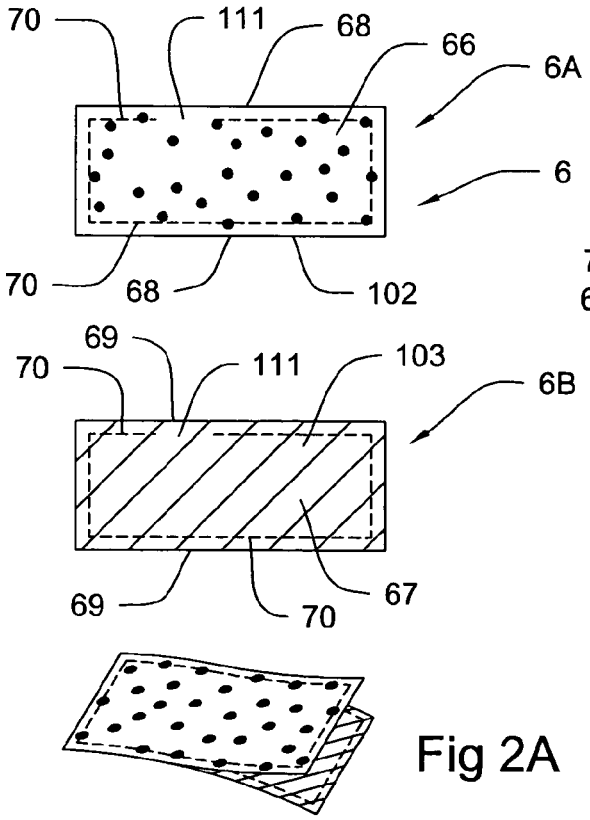
Fig 2A
Fig 3
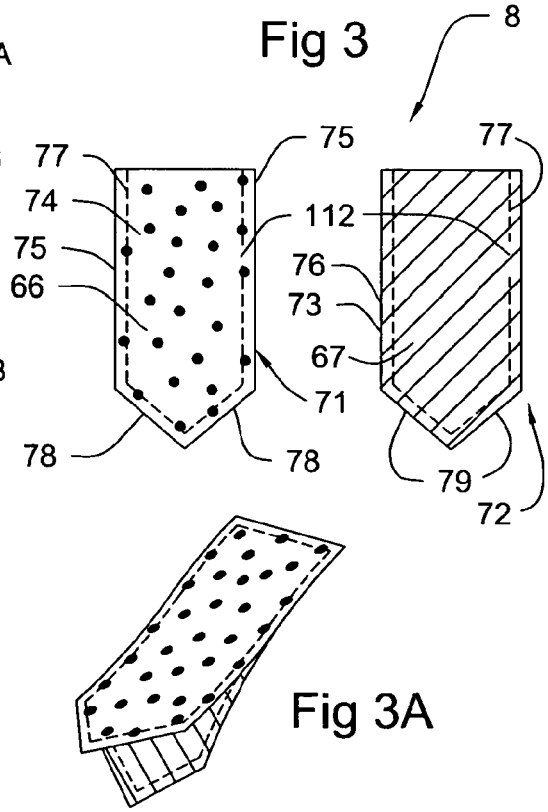
Fig 3A

REVERSIBLE NECKTIE

A. BACKGROUND OF THE INVENTION

1. Field of the Invention

This invention relates to neckwear in general and to an improved and reversible necktie in particular.

2. Prior Art

Standard neckties are well known in the prior art, however there remains a need for their improvement. In the prior art, many neckties are complex structures containing numerous adjustable elements, and lack of expertise on the part of the user often results in improper assembly of the necktie and makes the entire neck-tying process difficult. Such neckties also have increased manufacturing costs due to their complexity. Furthermore, many prior art neckties contain interfacing that makes the tie bulky and thus cumbersome to wear. In addition, many prior art neckties are not versatile, only comprising a rear-view side and a single front-view side, such that if the front-view side gets dirty or torn, the tie can no longer be utilized by the user, absent washing and/or mending. Moreover, many neckties in the prior art are not versatile in fashion, usually being designed to be worn by the male gender only. In addition, many prior art ties do not comprise an integrated mechanism to secure the necktie to the user's shirt in manner that is flexible and aesthetically pleasing. Therefore, a necktie meeting the following objectives is desired.

B. OBJECTS OF THE INVENTION

It is an object of the invention to provide an improved and versatile necktie, comprising two display sides and an integrated reversing mechanism, to allow the user to reverse the tie to selectively display either side.

It is another object of the invention to provide an improved, reversible, and adjustable necktie comprising an integrated securing mechanism to allow the user to adjustably secure the necktie to his or her shirt in a manner that is flexible and aesthetically pleasing.

It is another object of the invention to provide an improved and reversible necktie that maintains the aesthetics of conventional neckties.

Yet another object of the invention is to provide an improved and reversible necktie comprising an interfacing structure providing for an appropriate amount of thickness and durability, while not making the tie bulky or heavyweight.

It is another object of the invention to provide an improved and reversible necktie with a minimum of elements that is capable of being easily assembled and worn.

It is an another object of the invention to provide an improved and reversible necktie that makes the neck-tying process less difficult.

It is an object of the invention to provide an improved and reversible necktie capable of being manufactured at a reduced cost.

Yet another object of the invention is to provide an improved and versatile necktie that can be worn by both genders.

These and other objects and advantages of the invention shall become apparent from the ensuing figures and descriptions of the invention.

C. SUMMARY OF THE INVENTION

An improved, reversible, and versatile necktie is disclosed. The simple construction of the reversible necktie allows a male or female user to assemble and wear the necktie in a manner that is efficient and easy.

The necktie comprises a first display side attached to a second display side, with an interfacing structure situated between the two sides. The interfacing structure provides for an appropriate amount of thickness and durability, while not making the tie bulky or heavyweight. The necktie further comprises an integrated reversing mechanism that gives the user the option to selectively display either side of the necktie. The necktie further comprises an integrated securing mechanism, affixed to the reversing mechanism, for allowing the user to adjustably secure the necktie to the desired location on a shirt, in a manner that is both flexible and aesthetically pleasing.

D. BRIEF DESCRIPTION OF THE FIGURES

FIG. 1 depicts a preferred embodiment of the two display sides of the reversible necktie of the present invention.

FIGS. 2 and 2A present a preferred embodiment of the horizontal reversing strap of the present invention.

FIGS. 3 and 3A present a preferred embodiment of the vertical securing tab of the present invention.

Figure 6A:
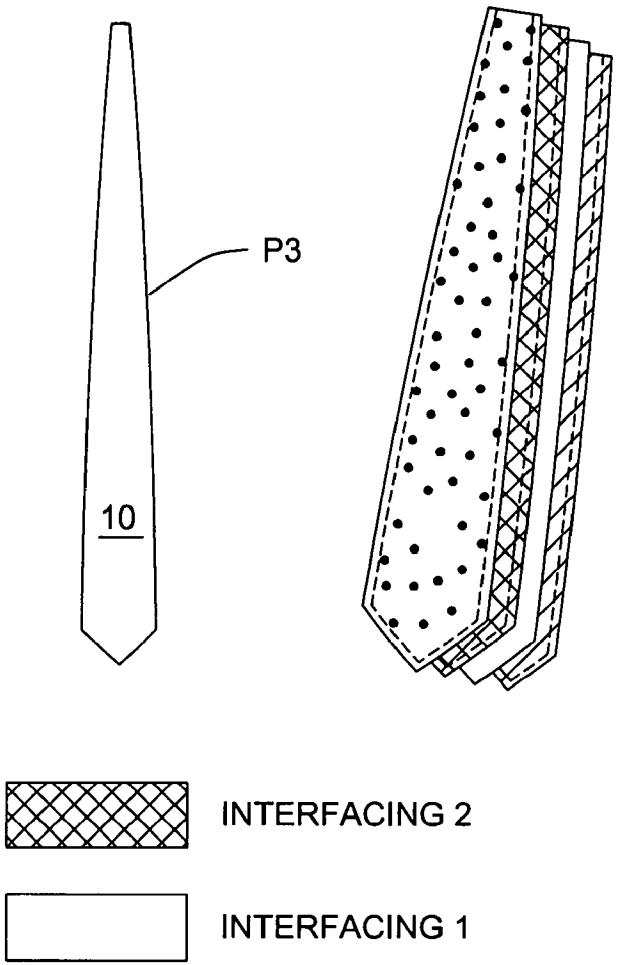
Figure 6:
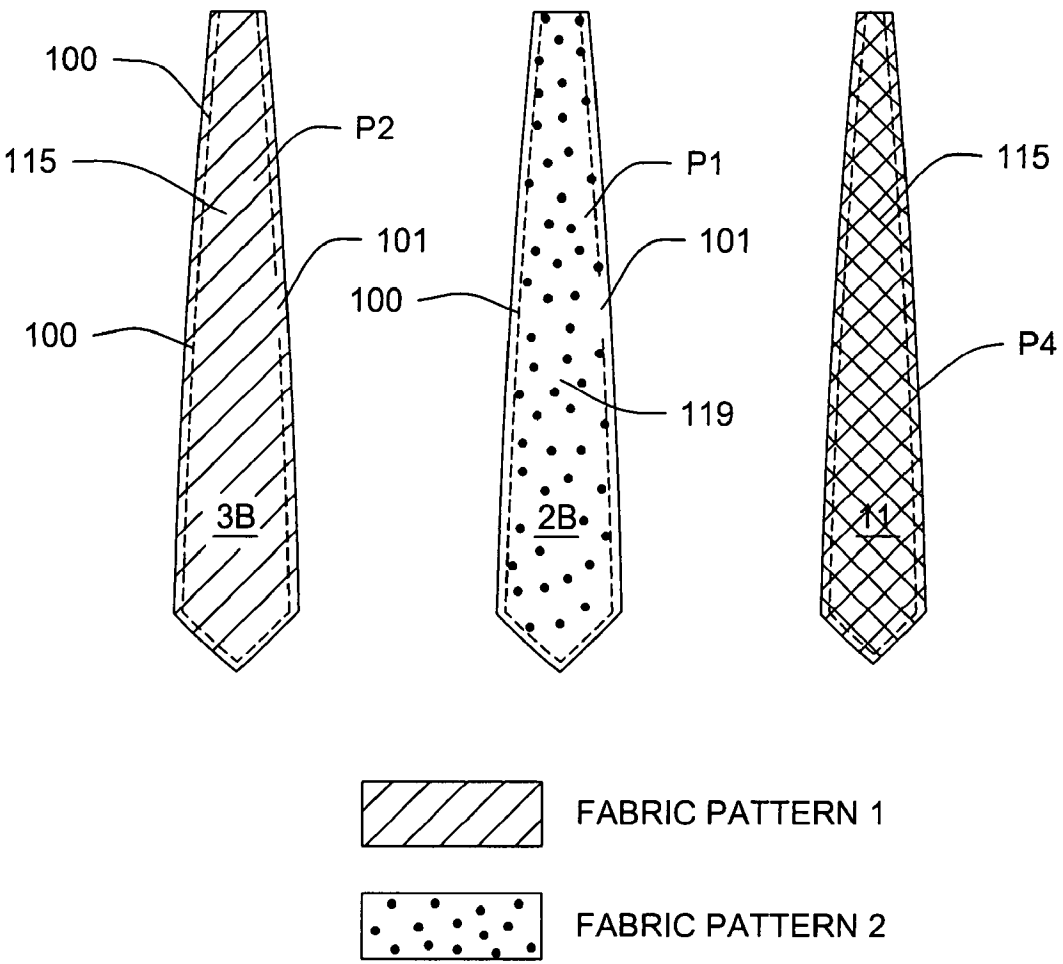

FIGS. 6 and 6A present views of the interfacing structure of the reversible necktie.

Figure 7:
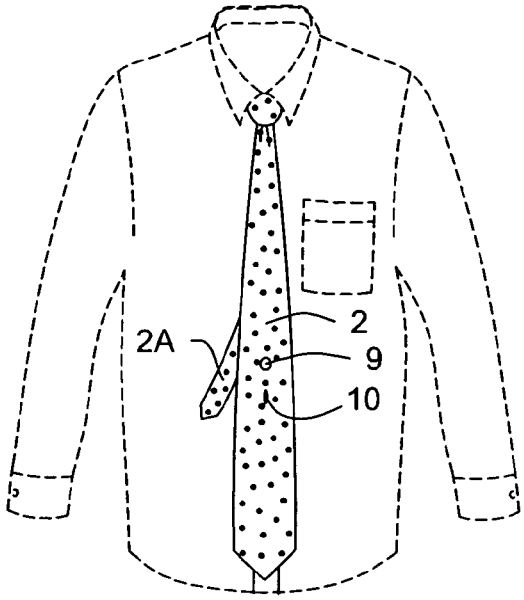

FIG. 7 presents a front view of the necktie fully assembled and worn, with the first side being displayed at a user desired length.

Figure 8:
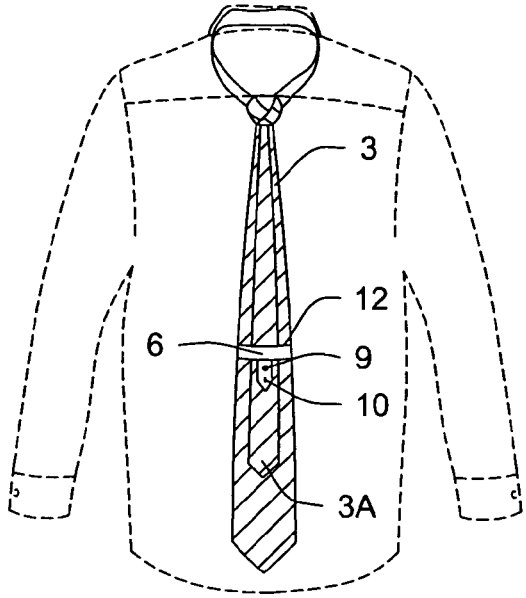

FIG. 8 presents a corresponding back view of FIG. 7, depicting the horizontal reversing strap restraining the smaller end section of the tie, and further depicting the vertical securing tab affixed to one of the user's shirt buttons via a first button hole.

Figure 9:
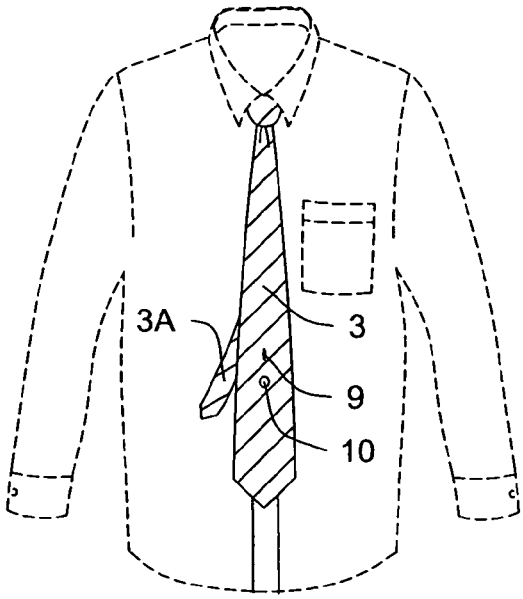

FIG. 9 presents a front view of the necktie fully assembled and worn, with the second side being displayed at an alternative user desired length.

Figure 10:
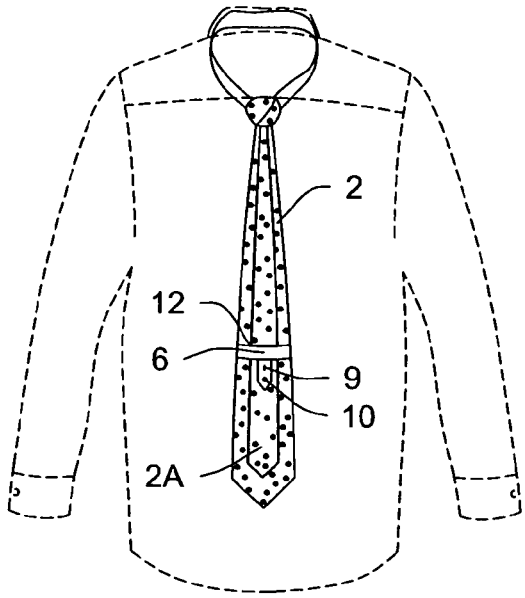

FIG. 10 presents a corresponding back view of FIG. 9, depicting the horizontal reversing strap restraining the smaller end section of the tie, and further depicting the vertical securing tab affixed to one of the user's shirt buttons via a second button hole.

E. DETAILED DESCRIPTION OF THE PREFERRED EMBODIMENTS OF THE INVENTION

An improved necktie 1 is disclosed. Necktie 1 comprises two display sides 2 and 3, with an improved interfacing structure 4 situated between the two sides 2 and 3. Necktie 1 of the present invention further comprises an integrated reversing mechanism 6 to display side 2 or side 3 of necktie 1, and an integrated securing mechanism 8 to secure necktie 1 to shirt, as discussed further below.

As depicted in FIG. 1, necktie 1 comprises a first display side 2 and a second display side 3, with each display side 2 and 3 corresponding to the shape of one-half of a conventional necktie. In a preferred embodiment, each display side, 2 and 3, further comprises a smaller end section, 2*a* and 3*a*, respectively, and a main body display section, 2*b* and 3*b*, respectively. In a further preferred embodiment, first display side 2 and second display side 3 are formed from two pattern materials, 66 and 67, respectively. The fabric material used to construct necktie 1 should be lightweight so as to minimize the weight of necktie 1, yet at the same time, provide for resilience, flexibility, and maximum durability. In a preferred embodiment, the inventor contemplates using silk, however other materials providing for the above desired characteristics may also be utilized. In a preferred embodiment, the pattern material 66 forming first display side 2 of necktie 1 is different than the pattern material 67 forming second display side 3 of necktie 1. In one preferred embodiment, pattern materials, 66 and 67, forming display sides 2 and 3 are both preferably gender neutral such that necktie 1 can be worn by both genders. For even further versatility, pattern material 66, forming display side 2 of necktie 1, can be designed for a male user, while pattern material 67 forming display side 3 can be designed for a female user. The patterns selected can be of a conservative nature i.e. comprising dark solids, or they can be of a casual nature, i.e. comprising bright colors, beading, sequencing, etc. Thus as can be seen, necktie 1 can be provided a plethora of designs and design combinations, depending on what is desired. Accordingly, necktie 1 can be utilized in a variety of applications, including but not limited to, formal occasions such as business meetings, parties, etc., or informal occasions such as casual get-togethers, picnics, etc.

In a preferred embodiment, and as depicted in FIG. 2, necktie 1 further comprises an integrated reversing mechanism 6 to allow the user to reverse necktie 1 to selectively display either side 2 or side 3 of necktie 1. In a preferred embodiment, integrated reversing mechanism 6 comprises a horizontal reversing strap 6 that is reversible, in and of itself, as will be further discussed below. In order to form horizontal reversing strap 6, two rectangular shaped pieces 6*a* and 6*b*, are cut, either from pattern material 66 forming display side 2 or from pattern material 67 forming display side 3. Alternatively, the user may choose to utilize a different pattern material from that of either display side 2 or 3 of necktie 1. The user can in fact choose any pattern material he desires to construct horizontal reversing strap 6 because when necktie 1 is assembled and worn by the user, horizontal reversing strap 6 will always be situated on the side 2 or 3 that is facing the user's body, as will be further discussed below. However, in a preferred embodiment, piece 6*a* of horizontal reversing strap 6 will be cut from pattern material 66 forming display side 2 while piece 6*b* of horizontal reversing strap will be cut from pattern material 67 forming display side 3. After rectangular shaped material pieces 6*a* and 6*b* have been cut, they are then placed together, with their respective right sides 102 and 103, facing each other and combined by stitching along the long sides 68, 69 of their respective perimeters. The location of preferred stitch lines 70 is depicted in FIG. 2. At this point, integrated securing mechanism 8, comprising a vertical tab 8, will be affixed, along stitch line 70, to one of pieces 6*a* or 6*b* forming horizontal reversing strap 6, as will be discussed further below. When rectangular shaped material pieces 6*a* and 6*b* are combined by stitching along long sides 68, 69 of their respective perimeters, a section 111 of the long sides 68, 69 will be left unstitched, i.e. long sides 68 and 69 will not be stitched together at section 111. In this manner, an opening will be formed in horizontal reversing strap 6 to allow material pieces 6*a* and 6*b* to be turned right side out, such that stitch lines 70 are hidden. The opening is then closed through stitching.

In a preferred embodiment, the width of completed reversing strap 6 will be approximately ½ to 1¾ inches. In general, the width of reversing strap 6 should preferably be equal to the mid-to-lower width of main body display section 2*b* or 3*b* of necktie 1, such that when reversing strap 6 is placed horizontally across either main body display section 2*b* or 3*b*, as will be discussed below, strap 6 will span the mid-to-lower body width of either main body display section 2*b* or 3*b*.

Figure 4:
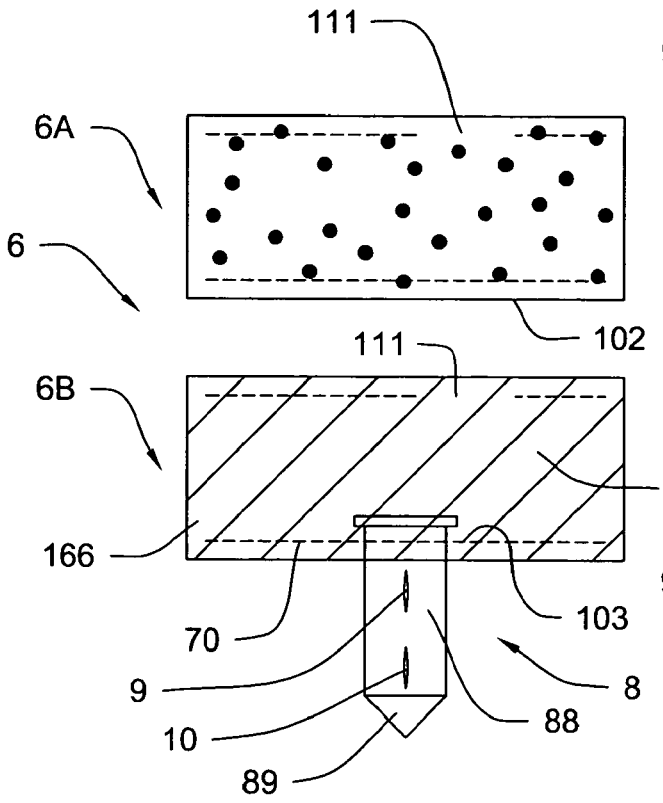
FIG. 4 depicts the assembly of the vertical securing tab to the horizontal reversing strap.
Figure 5:
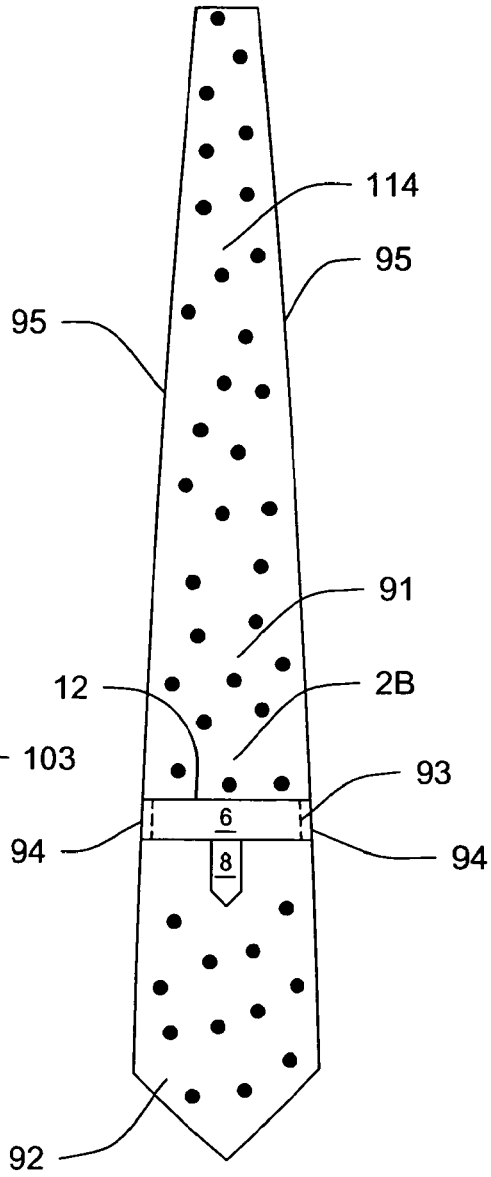
FIG. 5 depicts the placement of the horizontal reversing strap and the vertical securing tab on one main body display section of the necktie, with this main body display section facing right side up.

In a further preferred embodiment, and as depicted by FIG. 3, necktie 1 is further provided with an integrated securing mechanism 8 for allowing the user to adjustably secure reversible necktie 1 to a shirt button. In a preferred embodiment, securing mechanism 8 preferably comprises a vertical securing tab 8. Vertical securing tab 8 is preferably formed by cutting two elongated pieces 71 and 72 from either pattern material 66 forming display side 2 or from pattern material 67 forming display side 3 of necktie 1. The user can in fact choose any pattern material he desires to construct vertical securing tab 8 because when necktie 1 is assembled and worn by the user, vertical securing tab 8, like horizontal reversing strap 6, will always be situated on the side 2 or 3 of necktie 1 that is not being displayed. However, in a preferred embodiment, piece 71 will be cut from pattern material 66 forming display side 2 while piece 72 will be cut from pattern material 67 forming display side 3. After pieces 71 and 72 have been selected and cut, they are then placed together, with their respective right sides 73, 74 facing each other. The two elongated pieces 71 and 72, forming vertical securing tab 8, are then combined via stitch line 77 along the long sides 75, 76 and bottom sides 78, 79 of their respective perimeters. Long sides 75 and 76 are left unstitched at section 112 in order to form an opening in vertical securing tab 8 to allow elongated pieces 71 and 72 to be turned right side out, such that stitch line 77 is hidden. This opening is then closed through stitching. At this point, and as briefly mentioned above, vertical tab 8, will be affixed to one of pieces 6*a* or 6*b* forming horizontal reversing strap 6. In a preferred embodiment, vertical securing tab 8 will be combined along stitch line 70, to the lower end 166 of piece 6*b* of horizontal reversing strap 6, with piece 6*b* having its right side 103 up, as depicted in FIG. 4. In this manner, securing tab 8 will extend centrally and vertically a pre-determined distance from horizontal reversing strap 6. In a preferred embodiment, this distance corresponds to the length of securing tab 8, preferably about 2 inches. In a preferred embodiment, two button holes 9 and 10 are then stitched into vertical securing tab 8, approximately within a 2-inch span from each other. Preferably, first buttonhole 9 is stitched approximately in the middle section 88 of vertical securing tab 8 and second buttonhole 10 is stitched near the lower end 89 of vertical securing tab 8. This construction of vertical securing tab 8 is designed to accommodate the button placement structure of a conventional shirt, where the buttons generally are spaced approximately four inches apart, while also designed to accommodate shirts having button placement structures deviating from the convention. The design and construction of vertical securing tab 8 ensures that when necktie 1 is assembled and adjusted to the desired length, button holes 9 and 10 of vertical tab 8 will fall within at least ½ inch the distance between a user's shirt buttons, again taking into account different shirts and different button placement structures. This in turn will ensure that the user will be able to reach at least one of his or her shirt buttons to secure vertical securing tab 8 to his or her shirt. In essence, vertical tab 8 provides a pre-determined length of distance upon which a plurality of buttonholes can be situated, giving the user more versatility in terms of being able to adjust tie 1 to a desired length vis a vis the shirt and to subsequently secure tie 1 to a desired location on the shirt, as will be discussed further below.

In a further preferred embodiment, and as depicted by FIG. 4, reversing strap 6, with vertical securing tab 8 extending from same, is then placed across either main body display section 2*b* or 3*b*. For purposes of discussion and illustration, it will be assumed that this section is 2*b*. Reversing strap 6 will then be placed horizontally across the middle 91 to lower end 92 of main body display section 2*b*, with section 2*b* having its right side 114 face up. The short sides 94 of the perimeter of horizontal reversing strap 6 will then be stitched along line 93 to the longitudinal sides 95 of the perimeter of main body display section 2*b*, with a loop 12 being created between horizontal reversing strap 6 and main body display section 2*b*.

In a further preferred embodiment, and as depicted by FIG. 6, necktie 1 is provided with an interfacing structure 4, comprising a first interfacing 10 and a second interfacing 11. To create interfacing structure 4, first interfacing 10 is initially placed on either main body display section 2*b* or 3*b*. Display sections, 2*b* and 3*b* will preferably have equal perimeters P1 and P2, respectively. For purposes of discussion and illustration, first interfacing will be placed on main body display section 3*b*, which will be turned right side 115 up. In a preferred embodiment, the shape of first interfacing 10 will correspond to the shape of main body display section 3*b* and main body display section 2*b*, yet first interfacing 10 will have a smaller perimeter P3 than the perimeter P2 of section 3*b* and the perimeter P1 of section 2*b*. In a further preferred embodiment, first interfacing 10 will preferably be composed of material that will provide an appropriate amount of thickness and durability to necktie 1 when main body display sections 2*b* and 3*b* are combined.

In a further preferred embodiment, and as depicted by FIG. 6, second interfacing 11 is then placed over first interfacing 10, which in turn, is situated on main body display section 3*b*, as discussed above. Second interfacing 11 is preferably composed of a fusible web based or weave material that is thinner and lighter than the material forming first interfacing 10. In a preferred embodiment, the shape of second interfacing 11 will correspond to the shape of main body display section 3*b*, yet second interfacing 11 will have a smaller perimeter P4 than perimeter P2 of main body display section 3*b* and perimeter P1 of main body display section 2*b*. In a further preferred embodiment, second interfacing 11 is laid over first interfacing 10. When second interfacing 11 is laid over first interfacing 10, the perimeter, P4, of second interfacing 11 will preferably be greater than, and extend beyond, perimeter P3 of first interfacing 10, yet P4 will be less than perimeter P2 of section 3*b* and perimeter P1 of section 2*b*. Thus, perimeter P3 of first interfacing 10 will be contained within perimeter P4 of second interfacing 11, which in turn will lie inside perimeter P2 of section 3*b*. An iron is then passed over second interfacing 11, the heat triggering the fusion of second interfacing 11 to first interfacing 10. In this fashion, second interfacing 11 functions to retain first interfacing 10 in position on main body display section 3*b*. The utilization of second interfacing 11, in conjunction with first interfacing 10, provides for several advantages as opposed to the utilization of first interfacing alone 10. If first interfacing 10 were to be utilized solely, then first interfacing 10 would have to be a fusible material in and of itself. Such self-fusible material could potentially be utilized to construct first interfacing 10, however such material would be undesirably thicker than necessary and would thus add bulkiness to necktie 1. Furthermore, if first interfacing 10 were to be used by itself, and it did not posses fusible characteristics to retain it in position within necktie 1, then first interfacing 10 would have to be stitched to main body display sections 2*b* and 3*b* to hold it in place therebetween. This in turn would result in a thicker and bulkier seam line. These noted problems, however, are eliminated, if second interfacing 11 is utilized in conjunction with first interfacing 10. As discussed above, second interfacing 11 functions to hold first interfacing 10 in place, thus eliminating the problem of having to use a first interfacing 10 that could be fusible in and of itself, but would also be unnecessarily bulkier. Furthermore, the utilization of second interfacing 11 is further advantageous, in that when main body display sections 2*b* and 3*b* are combined, second interfacing 11, by holding first interfacing 10 in place, eliminates the need to stitch first interfacing 10 to main body display sections 2*b* and 3*b*. This in turn results in a thinner seam line, giving necktie 1*a* more streamlined and aesthetically pleasing appearance.

After second interfacing 11 has been fused to first interfacing 10, situated on main body display section 3*b*, the two main body display sections 2*b* and 3*b*, are then placed together, with their respective right sides, 114 and 115, facing each other. The two sections 2*b* and 3*b*, having first interfacing 10 and second interfacing 11 situated therebetween, are then combined via stitch line 100 running alongside the perimeters P1 and P2 of sections 2*b*, 3*b*, leaving an unstitched area 101 forming an opening along this region. Main body display sections 2*b* and 3*b* are then turned right side out through the opening to hide stitch line 100, and the opening is then closed through stitching.

To complete the formation of display sides 2 and 3 of necktie 1, appropriate smaller end sections 2*a* and 3*a*, are then constructed and affixed to main body display sections 2*b* and 3*b*, respectively, in the conventional manner known in the prior art.

Thus as can be seen from the foregoing discussion, the construction of necktie 1 is simple and allows for a reduced manufacturing cost, yet provides for a variety of benefits, as will be further discussed below The assembly of necktie 1 tie for wearing will now be discussed. The user will first select the side 2 or 3 of necktie 1 that he wishes to display and which will be most suitable for his or her intended application. It will be assumed for purposes of discussion, and as a beginning reference point, that the side the user wishes to display is side 2. In this scenario, horizontal reversing strap 6 will be situated on the side that is not being displayed, i.e. side 3, more specifically along the mid to lower end of main body display section 3*b*. The user will then drape necktie 1 around his or her neck so that chosen display side 2 is facing forward. The user will next began assembling tie 1 around his or her neck in the conventional manner well known in the art. During assembly, as depicted by FIGS. 7 and 8 the chosen display side 2 will be facing forward towards public view and the non-displayed side 3, and horizontal reversing strap 6, will be facing inwards, towards the user's shirt. At this point, the user can adjust the length of necktie 1, relative to his or her shirt, to achieve the desired length of chosen display side 2. An exemplary length is depicted in FIGS. 7 and 8. The ultimate length of necktie 1 that the user desires to display will depend upon several factors, i.e. the dictates of fashion, the user's body size, type of shirt worn, etc. After necktie 1 has been adjusted for its desired display length, the user can then secure his or her shirt to vertical securing tab 8 via one of button holes 9 or 10 situated on vertical tab 8. In one embodiment, as depicted by FIGS. 7 and 8, the user will utilize buttonhole 10, situated near lower end 89 of vertical securing tab 8 to secure necktie 1 to his or her shirt. As discussed above, the design and construction of vertical securing tab 8 and its buttonhole arrangement, ensures that the user will be able to reach at least one shirt button and at least one of buttonholes 9 or 10 to secure vertical securing tab 8 to his or her shirt. As can be seen from the foregoing, the inventor has thus presented and optimum configuration for necktie 1. By providing tie 1 with vertical securing tab 8 i.e. an elongated pre-determined length of area upon which a plurality of button holes are appropriately positioned, this ultimately allows the user to have more flexibility in adjusting the length of necktie 1 and thereupon choosing the location on the shirt upon which he or she desires to secure necktie 1. At this point, the user can also restrain smaller end section, 2*a* of tie 1 by inserting smaller end section 2*a* through loop 12 created by horizontal restraining strap 6 and main body display section 3*b*. This will prevent smaller end section 2*a* from flapping around and potentially exposing the reverse side pattern of smaller end section 3*a*

For exemplary purposes, assuming that the user now desires to display the other side of necktie 1, i.e. side 3. The user will first disassemble necktie 1 in the conventional manner known in the prior art and then remove necktie 1 from his or her person. The user will next lay out necktie 1 so that display side 3, and horizontal reversing strap 6, situated on main body display section 3*b*, is facing upwards. The user will then reverse necktie 1, i.e. make side 3 suitable for display, by bringing the smaller end 3*a* of necktie 1 through loop 12 created by horizontal reversing strap 6 and main body display section 3*b*, thereby exposing reverse side 2. The user will then pull the entire length of side 2 through loop 12, and flip over horizontal reversing strap 6, such that horizontal reversing strap 6 is moved from main body display section 3*b*, to main body display section 2*b*. In this fashion, horizontal reversing strap 6 is reversed from the side that the user now desires to expose, side 3, to the side the user now desires to hide, side 2. Side 3 is thus now suitable for display. The user will then assemble tie 1 around his neck in the conventional manner well known in the art. The user can, at this point, adjust the length of necktie 1 to his desire. An exemplary length is depicted in FIGS. 9 and 10. In this scenario, necktie 1 is then secured to a shirt button via buttonhole 9 situated near the middle section 88 of vertical tab 8. After the user has properly assembled tie 1 on his or her person, chosen display side 3 will be facing forward towards public view, while side 2 and horizontal reversing strap 6 situated on side 2, will be facing inwards, towards the user's shirt. The user can then bring smaller end 3*a* of side 3 through loop 12 created by horizontal restraining strap 6 and main body display section 2*b* to restrain this end from flapping around and exposing the reverse side pattern of smaller end section 2*a*.

In summary, the present invention provides a new and improved and reversible necktie 1 that is easy to assemble and to wear. Necktie 1 is durable in construction, yet maintains a streamlined and aesthetically pleasing appearance. Necktie 1 is versatile in that it comprises dual display sides, is suitable for both genders, and can be utilized in a plethora of applications. The invention is further versatile in that it allows the user to display the desired length of side 2 or 3, and to further adjustably secure necktie 1 to the desired location on a shirt, in a manner that is both flexible and aesthetically pleasing.

While the invention has been described in terms of its preferred embodiment, other embodiments will be apparent to those of skill in the art from a review of the foregoing. Those embodiments as well as the preferred embodiments are intended to be encompassed by the scope and spirit of the following claims.

We claim:

1. A reversible necktie comprising:

a. a first display side and a second display side;

b. an integrated reversing strap for allowing a user to reverse the necktie to selectively display the first side or the second side of the necktie:

c. wherein the integrated reversing strap is placed horizontally across one of the display sides of the necktie;

d. wherein the integrated strap is also reversible itself, such that the integrated reversing strap can be flipped from one display side to the other display side;

e. an integrated securing tab, extending vertically a predetermined distance from the integrated reversing strap, wherein the integrated securing tab comprises a plurality of buttonholes for allowing the user to adjustably secure the reversible necktie to a shirt button.

2. A reversible necktie according to claim 1, wherein the position of the integrated strap is at or near the middle to lower end of one of the display sides.

3. A reversible necktie comprising:

a. a first display side and a second display side, wherein each display side corresponds to the shape of one-half of a conventional necktie;

b. an integrated reversing strap for allowing a user to reverse the necktie to selectively display the first side or the second side of the necktie;

c. wherein the integrated reversing strap is placed horizontally across one of the display sides of the necktie;

d. wherein the integrated reversing strap is also reversible itself, such that the integrated reversing strap can be flipped from one display side to the other display side;

e. wherein the first display side comprises a first main body display section and the second display side comprises a second main body display section, wherein the first main body display body section has a first perimeter p1, wherein the second main body display section has a second perimeter p2, wherein the first perimeter p1 is equal to the second perimeter p2;

f. wherein the necktie includes a first interfacing material positioned between the first main body display section and the second main body display section; wherein the first interfacing has a perimeter p3 that is less than the perimeter p1 of first main body display section and less than the perimeter p2 of second main body display section;

g. wherein the necktie further includes a second interfacing material overlaid on the first interfacing material to retain the first interfacing material between the first main body display section and the second main body display section, wherein the second interfacing material has a perimeter p4 that is greater than the perimeter p3 of the first interfacing material, but wherein the perimeter p4 of the second interfacing material is less than the perimeter p1 of the first main body display section and less than the perimeter p2 of the second main body display section;

h. wherein the first main body display section and the second main body display section are combined together along their respective perimeters p1, and p2, to form the necktie.

4. A reversible necktie according to claim 3, further comprising an integrated securing tab, extending vertically a predetermined distance from the integrated reversing strap, wherein the integrated securing tab comprises a plurality of buttonholes for allowing the user to adjustably secure the reversible necktie to a shirt button.

* * * * *